US005892420A

United States Patent [19]

Larranaga et al.

[11] Patent Number: 5,892,420

[45] Date of Patent: Apr. 6, 1999

[54] ELECTRONIC CIRCUIT BREAKER HAVING MODULAR CURRENT TRANSFORMER SENSORS

[75] Inventors: Javier I. Larranaga, Bristol; Joseph Criniti, New Britain, both of Conn.; Alberto A. Figueroa, San Juan, Puerto Rico

[73] Assignee: General Electric Company, Schenectady, N.Y.

[21] Appl. No.: 704,071

[22] Filed: Aug. 28, 1996

[51] Int. Cl.[6] ..... H01H 73/00

[52] U.S. Cl. ..... 335/18; 336/188

[58] Field of Search ..... 335/18, 202, 16, 335/147, 195; 218/22; 336/182, 183, 188

[56] References Cited

U.S. PATENT DOCUMENTS

| | | | |
|---|---|---|---|
| 3,990,030 | 11/1976 | Chamberlin | 336/171 |
| 4,103,268 | 7/1978 | Anders et al. . | |
| 4,281,359 | 7/1981 | Bayer et al. . | |
| 4,672,501 | 6/1987 | Bilac et al. . | |
| 4,683,518 | 7/1987 | Gwozdz | 361/263 |
| 4,754,247 | 6/1988 | Raymont et al. . | |
| 5,015,983 | 5/1991 | DeRosier et al. . | |
| 5,422,619 | 6/1995 | Yamaguchi et al. | 336/184 |
| 5,515,597 | 5/1996 | Herbst et al. . | |
| 5,705,961 | 1/1998 | Yee | 336/131 |
| 5,719,547 | 2/1998 | Kaneko et al. | 336/180 |

*Primary Examiner*—Lincoln Donovan

*Attorney, Agent, or Firm*—Cantor Colburn LLP; Carl B. Horton

[57] ABSTRACT

A compact current transformer is formed by arranging a pair of secondary windings on opposite sides of a single turn primary winding. A core is then wound about the primary winding and part of the secondary winding coils from a continuous roll of metal strap. The secondary windings are arranged on a pair of bobbins on opposite sides of the transformer core. A modular twin bobbin arrangement allows the secondary windings to be wound from a continuous source of transformer wire. The continuous wound core eliminates air gaps and improves magnetic transfer between the primary winding and the secondary winding. The continuous transformer wire eliminates the need for soldering or welding to connect between the two secondary windings.

17 Claims, 2 Drawing Sheets

ELECTRONIC CIRCUIT BREAKER HAVING MODULAR CURRENT TRANSFORMER SENSORS

BACKGROUND OF THE INVENTION

The use of electronic trip units in low-ampere industrial-rated circuit breakers has often been forestalled because of size constraints on the discreet electrical and electromagnetic components within the circuit breaker enclosure. The current transformer used in conjunction with the electronic trip unit, has a two-fold requirement namely, to provide an input signal to the trip unit representative of the current flow within the associated protected power circuit while providing the necessary input power to the trip unit power supply. A predetermined maximum core volume is required within the current transformer to ensure that the current transformer does not become magnetically saturated upon the occurrence of overcurrent conditions when used within compact circuit breakers having variable ampere ratings while a predetermined minimum core volume insures that the core will become sufficiently magnetized at the lower steady-state operating current levels.

With earlier-designed electronic trip circuit breakers, such as described within U.S. Pat. No. 4,281,359 entitled "Static Trip Unit for Molded Case Circuit Breakers", for example, a standard trip unit circuit is employed over a wide range of ampere ratings while the size of the current transformer used to sense the input current to the trip unit circuit is correspondingly increased in proportion to the increased ampere rating.

When compact electronic trip unit circuit breakers employing various accessory devices, such as described in U.S. Pat. No. 4,754,247 entitled "Molded Case Circuit Breaker Accessory Enclosure", are used within industrial rated power distribution circuits, the size constraints of the circuit breaker enclosure limit the geometry of the current transformer core to a size just sufficient to provide operating power to the electronic trip unit circuit without becoming saturated at the higher ampere ratings due to the low inductance of the smaller core. Another problem involved with the use of small-sized current transformer cores is the lack of sufficient core inductance to provide the requisite core magnetization for transformer operation at the lower ampere ratings.

U.S. Pat. No. 5,515,597 entitled "Method for Assembling a Current Transformer" describes a compact core arrangement for current transformers and the like that is accomplished by winding the secondary coils around the completed magnetic core.

U.S. Pat. No. 5,015,983 entitled "Compact Circuit Interrupter Having Multiple Ampere Ratings" describes a compact current transformer arrangement using a metal core formed from laminations of silicon sheet steel positioned over a pair of secondary windings. The air gaps inherent with such laminated steel plates increase the core losses that are subsequently compensated for by increasing the core size and the amount of core material.

U.S. patent application Ser. No. 08/663,760 entitled "Compact Circuit Interrupter Having Multiple Ampere Ratings" describes a compact current transformer used within circuit breakers having electronic trip units. The continuous arrangement of a sheet of core material about the primary winding provides a transformer core without air gaps. When current transformers are formed about a pair of secondary winding coils the two coils are separately wound on individual bobbins and are later electrically connected together such that the directions of the wires in each of the coils is in opposite directions. One early example of a pair of miniature coil bobbins used within telephone receivers is found within U.S. Pat. No. 4,103,268 entitled "Dual Coil Hinged Bobbin Assembly".

It would be advantageous to arrange the separate bobbins in such a manner that the coils could then be wound from a continuous source of wire without requiring separate connection operations and orientation as is now required.

One purpose of the invention is to provide a unique bobbin arrangement that allows the two coils to be wound from a single source of wire to eliminate the inter-coil connection process.

SUMMARY OF THE INVENTION

A compact electronic trip circuit breaker of the type employing a signal processor circuit in combination with current sensing utilizes a fixed transformer core size and a fixed secondary winding on the core to meet the size constraints of the compact circuit breaker enclosure. The secondary winding is in the form of a pair of secondary arranged on a pair of bobbins on opposite sides of the transformer core. A modular twin bobbin arrangement allows a pair of secondary to be wound from a continuous source of transformer wire. A flexible connection between the bobbins allows the secondary to be positionally arranged on the transformer without separate soldering or welding operations.

DESCRIPTION OF THE PREFERRED EMBODIMENT

Figure 1:
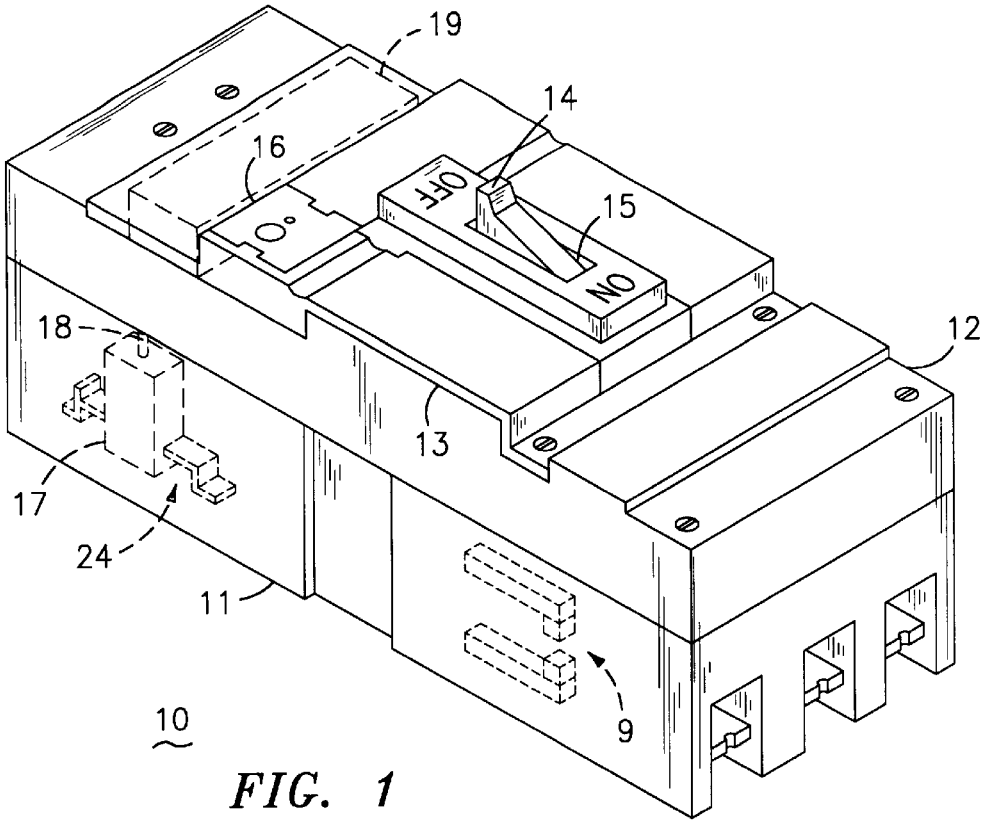
FIG. 1 is a top perspective view of a circuit breaker employing the modular bobbin current transformer according to the invention.

A circuit breaker 10 having an electronic trip unit such as described in U.S. Pat. No. 4,672,501 entitled "Circuit Breaker and Protective Relay Unit" is depicted in FIG. 1 wherein the circuit breaker case 11 containing the circuit breaker components is sealed by means of a circuit breaker cover 12 and an accessory cover 13. The circuit breaker is manually switched ON and OFF by means of a handle operator 14 which projects through the handle slot 15 allows ON of OFF control of the circuit breaker contacts 9 while the electronic trip unit 19 automatically provides for contact separation upon occurrence of and overcurrent condition. An externally-accessible rating plug 16 within the accessory cover sets the circuit breaker ampere rating to the trip unit 19. The circuit current is sampled by means of the current transformers 17 arranged around load straps 24 extending within the circuit breaker case that connect with the electronic trip unit 19 by means of terminals 18.

Figure 2:
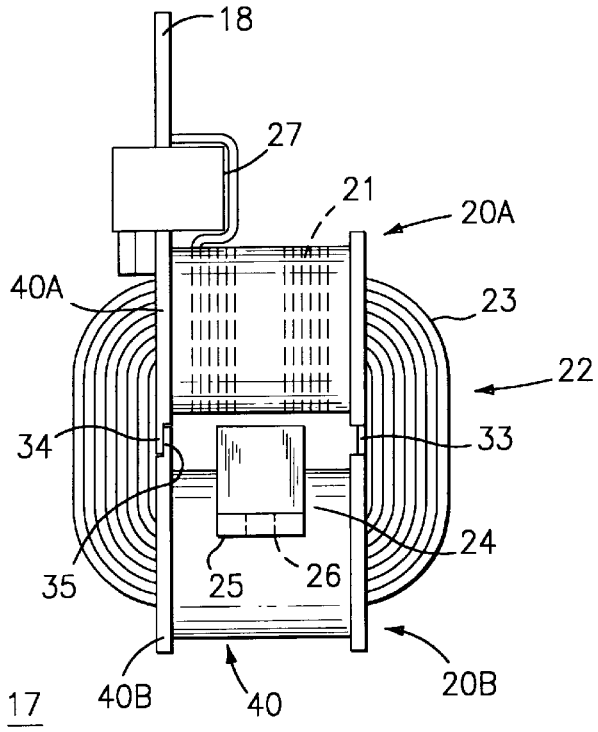
FIG. 2 is a front perspective view of the modular bobbin current transformer of FIG. 1.

The current transformer 17 is shown in FIG. 2 to consist of a pair of top and bottom secondary windings 20A, 20B arranged over the load strap 24 and joined by means of a core 22. The current transformer is similar to that described within aforementioned U.S. patent application Ser. No.

08/663,760. A similar pair of terminals 18 extend from a similar plastic block 27 and are electrically connected with the secondary windings 20A, 20B. The wire conductors 21 are wound perpendicular to the major dimension of the continuous or "wrapped" core 22 consisting of a continuous layer of a magnetic flat strip of metal is depicted at 23. Electrical connection with the electrical components within the circuit breaker are made by means of the load terminal plate 25 at the end of the load strap 24 and which includes a threaded aperture 26 for ease of connection. The current transformer differs from the aforementioned current transformer by the provision of the modular bobbin 40 consisting of the top bobbin 40A and bottom bobbin 40B upon which the wire conductors 21 are arranged to form the corresponding top and bottom secondary windings 20A, 20B. The top and bottom bobbins are connected by means of flexible tab 33 and are supported by means of the steps 34, 35 that overlap for added strength.

Figure 3:
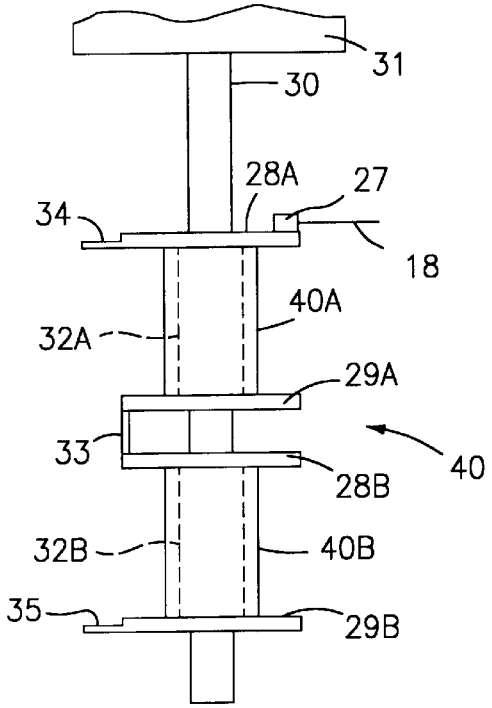
FIG. 3 is front plan view of the modular bobbin of FIG. 2 arranged on a coil winding machine.
Figure 4:
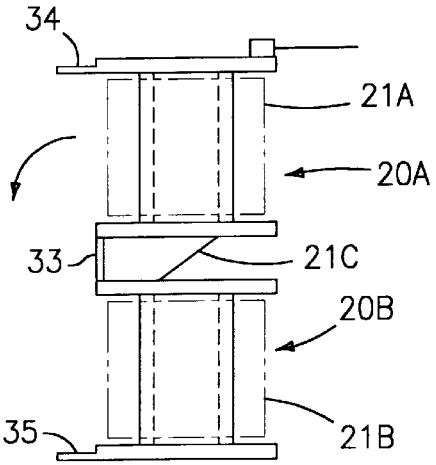
FIGS. 4–6 are front views of the secondary arranged on the modular bobbin of FIG. 3 prior to arrangement of the transformer core.

In accordance with the teachings of the invention, the modular bobbin 40 as shown in FIGS. 2, 3 and 4 is arranged on the mandrel 30 of a coil winding machine 31 by extending the mandrel through the elongated circular apertures 32A, 32B extending through the top and bottom bobbins 40A, 40B. The top bobbin includes opposing top and bottom flanges 28A, 29A and the bottom bobbin includes opposing top and bottom flanges 28B, 29B along with the bottom step 35, as indicated. The plastic block 27 containing the terminals 18 is attached to one side of top flange 28A and the step 34 extends from the opposite side therefrom. The flexible tab 33 extends between the bottom flange 29A on the top bobbin 40A and the top flange 28B on the bottom flange 40B. The first wire turns 21A are formed by rotating the mandrel 30 in a first direction until the top secondary winding 20A is completed. The direction of the mandrel is then reversed to wind the second wire turns 21B in the opposite direction. This reverse arrangement of the top and bottom secondary windings allows the placement of the secondary windings in the proper magnetic sense with respect to the magnetic flat strip of metal 23 which constitutes the transformer core 22.

Figure 6:
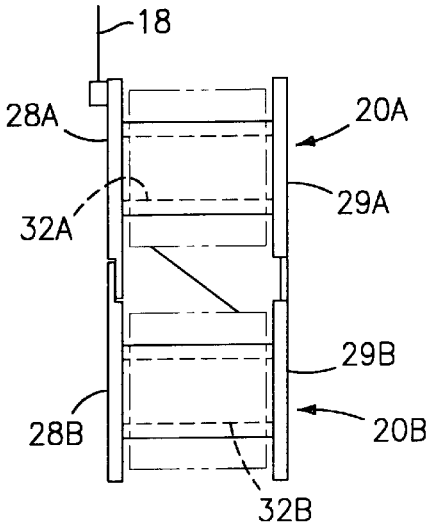
Figure 5:
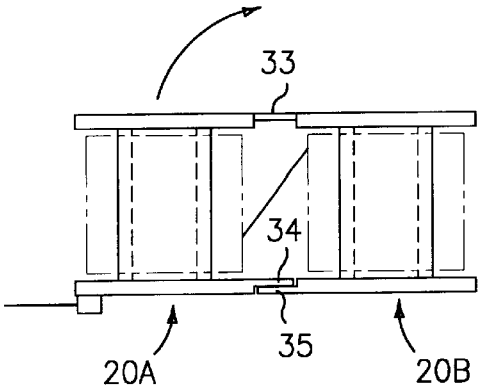

Referring now to FIGS. 4, 5 and 6, after the top and bottom secondary winding 20A, 20B are formed by the provision of the wire turns 21A, 21B, the completed top and bottom secondary windings 20A, 20B are folded and positioned to complete the current transformer 17 shown earlier in FIG. 2. The top winding 20A, with the first wire turns 21A interconnected with the bottom secondary winding 20B as indicated at 21C, is rotated in the indicated counterclockwise direction about the flexible tab 33 to bring the steps 34 and 35 into contact as shown in FIG. 5. The top and bottom secondary windings 20A, 20B are next rotated in the indicated clockwise direction to position the top secondary winding 20A over the bottom secondary winding 20B such that the wire terminals 18 extend upwards from the top flange 28A on the top secondary winding 20A. The top flange 28A on the top secondary winding 20A is positioned over the top flange 28B on the bottom secondary winding 20B. The bottom flange 29A on the top secondary winding 20A is positioned over the bottom flange 29B on the bottom secondary winding 20B. This arrangement now positions the top and bottom apertures 32A, 32B to receive the magnetic flat strip of metal 23 to complete the current transformer 17 as shown in FIG. 2.

We claim:

1. A compact circuit breaker having variable ampere ratings for providing circuit current to a protected circuit comprising:

a molded plastic circuit breaker cover and a molded plastic circuit breaker case;

a pair of separable contacts within said case and arranged for interrupting the circuit current upon an occurrence of an overcurrent condition through said contacts;

an electronic trip unit arranged within said circuit breaker cover for controlling operation of said contacts; and a current transformer within said case connected with said trip unit for providing operating power to said trip unit and providing a current signal to said trip unit representative of the circuit current, said current transformer comprising:

a primary winding;

a metal core arranged about said primary winding;

first and secondary windings arranged on opposite sides of said primary winding, said first secondary winding comprising first wire turns arranged on a first bobbin having first and second first bobbin ends, said second secondary winding comprising second wire turns arranged on a second bobbin having first and second bobbin ends, said first end of said first bobbin being joined to said first end of said second bobbin, said first wire turns being arranged on said first bobbin in a first direction and said second wire turns being arranged on said second bobbin in a second direction opposite said first direction, said first and second wire turns being formed from a continuous wire.

2. The circuit breaker of claim 1 including a first step arranged on said second end of said first bobbin and a second step arranged on said second end of said second bobbin, said first step and said second step being arranged in overlapping relation.

3. The circuit breaker of claim 1 wherein said first end of said first bobbin is joined to said first end of said second bobbin by a flexible tab.

4. The circuit breaker of claim 1 wherein said first bobbin first end comprises a first top flange and said first bobbin second end comprises a first bottom flange.

5. The circuit breaker of claim 4 including a first axial aperture extending between said first top flange and said first bottom flange.

6. The circuit breaker of claim 5 wherein said second bobbin first end comprises a second top flange and said second bobbin second end comprises a second bottom flange.

7. The circuit breaker of claim 6 including a second axial aperture extending between said second top flange and said second bottom flange.

8. The circuit breaker of claim 7 including a transformer core whereby a portion of said core is inserted within said first axial aperture and an opposing portion of said core is inserted within said second axial aperture.

9. A current transformer for circuit breaker electronic trip units comprising:

a primary winding;

a metal core arranged about said primary winding; and first and secondary windings arranged on opposite sides of said primary winding, said first secondary winding comprising first wire turns arranged on a first bobbin having first and second first bobbin ends, said second secondary winding comprising second wire turns arranged on a second bobbin having first and second bobbin ends, said first end of said first bobbin being joined to said first end of said second bobbin, said first wire turns being arranged on said first bobbin in a first direction and said second wire turns being arranged on said second bobbin in a second direction opposite said first direction, said first and second wire turns being formed from a continuous wire.

10. The current transformer of claim 9 wherein said first end of said first bobbin is joined to said first end of said second bobbin by a flexible tab.

11. The current transformer of claim 9 wherein said first bobbin first end comprises a first top flange and said first bobbin second end comprises a first bottom flange.

12. The current transformer of claim 11 including a first axial aperture extending through said first bobbin and a second axial aperture extending through said second bobbin, said first bobbin being oriented to said second bobbin whereby said first axial aperture extends in a plane parallel with said second aperture.

13. The current transformer of claim 12 wherein said first axial aperture extends between said first top flange and first bottom flange.

14. The current transformer of claim 13 wherein said second axial aperture extends between a second top flange and a second bottom flange.

15. The current transformer of claim 14 wherein said second bobbin first end comprises said second top flange and said second bobbin second end comprises said second bottom flange.

16. The current transformer of claim 15 wherein said second axial aperture extends between said second top flange and said second bottom flange.

17. The current transformer of claim 11 including a transformer core whereby a portion of said core is inserted within said first axial aperture and an opposing portion of said core is inserted within said second axial aperture.

* * * * *